US010662943B2

(12) United States Patent
Goettlinger et al.

(10) Patent No.: US 10,662,943 B2
(45) Date of Patent: May 26, 2020

(54) EXTERNAL ROTOR PUMP WITH A SURFACE STRUCTURE HAVING A LOAD-BEARING REGION AND A NON-LOAD BEARING REGION

(71) Applicant: Bayerische Motoren Werke Aktiengesellschaft, Munich (DE)

(72) Inventors: Markus Goettlinger, Munich (DE); Ulrich Gutzer, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 255 days.

(21) Appl. No.: 15/722,164

(22) Filed: Oct. 2, 2017

(65) Prior Publication Data

US 2018/0023562 A1 Jan. 25, 2018

Related U.S. Application Data

(63) Continuation of application No. PCT/EP2016/061671, filed on May 24, 2016.

(30) Foreign Application Priority Data

Jul. 8, 2015 (DE) ..... 10 2015 212 724

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 2/332*** | (2006.01) |
| ***F04C 2/10*** | (2006.01) |

(Continued)

(52) U.S. Cl.

CPC ..... *F04C 2/332* (2013.01); *F01C 21/0881* (2013.01); *F04C 2/086* (2013.01);

(Continued)

(58) Field of Classification Search

CPC ..... F04C 2/102; F04C 2/332; F04C 2/086; F04C 2/348; F04C 15/0088;

(Continued)

(56) References Cited

U.S. PATENT DOCUMENTS

2009/0087334 A1* 4/2009 Whitesell ..... F01C 21/0845 418/136
2015/0037194 A1* 2/2015 Kan ..... F04C 2/084 418/206.8
2016/0305425 A1* 10/2016 Sakai ..... F04C 2/102 418/171

FOREIGN PATENT DOCUMENTS

CN 104343679 A 2/2015
DE 195 32 703 C1 11/1996

(Continued)

OTHER PUBLICATIONS

EP1319837A1—Tran et al.—Gerotor Pump—Jun. 18, 2003—English Translation (Year: 2003).*

(Continued)

*Primary Examiner* — Theresa Trieu

(74) *Attorney, Agent, or Firm* — Crowell & Moring LLP

(57) ABSTRACT

An external rotor pump has an outer rotor with a sliding surface which is arranged on the outer side thereof, and an opposing body in which the outer rotor is mounted rotatably by way of the sliding surface thereof on an inner guide surface of the opposing body and is in mechanical contact with the inner guide surface. An inner rotor which is mounted such that it can be rotated eccentrically with respect to the outer rotor is provided. The sliding surface or the inner guide surface has a surface structure which has a load-bearing region and a non-load-bearing region which is depressed in contrast with the former.

16 Claims, 5 Drawing Sheets

(51) Int. Cl.

| | |
|---|---|
| ***F04C 2/08*** | (2006.01) |
| ***F01C 21/08*** | (2006.01) |
| ***F04C 2/348*** | (2006.01) |
| ***F04C 15/00*** | (2006.01) |

(52) U.S. Cl.
CPC ..... *F04C 2/102* (2013.01); *F04C 2/348* (2013.01); *F04C 15/0088* (2013.01); *F04C 2230/22* (2013.01); *F04C 2240/30* (2013.01); *F04C 2270/16* (2013.01); *F05C 2201/04* (2013.01); *F05C 2201/0448* (2013.01); *F05C 2203/0808* (2013.01); *F05C 2225/00* (2013.01)

(58) Field of Classification Search
CPC ..... F04C 2270/16; F04C 2230/22; F04C 2240/30; F01C 21/0881; F05C 2201/00; F05C 2201/04; F05C 2201/0448; F05C 2203/0808; F05C 2225/00; F05C 2225/02
USPC ..... 418/26, 152–153, 178–179, 166, 171, 418/266–268
See application file for complete search history.

(56) References Cited

FOREIGN PATENT DOCUMENTS

| | | | |
|---|---|---|---|
| DE | 10 2007 055 911 | A1 | 7/2008 |
| DE | 10 2012 219 847 | A1 | 4/2014 |
| EP | 1 319 837 | A1 | 6/2003 |
| EP | 2 833 000 | A2 | 2/2015 |
| JP | 58-217788 | A | 12/1983 |
| JP | 2003-176790 | A | 6/2003 |
| JP | 2011-32892 | A | 2/2011 |
| JP | 2013-199850 | A | 10/2013 |
| WO | WO 2006/047986 | A1 | 5/2006 |

OTHER PUBLICATIONS

WO2006047986A1—MAAS Johannes—Pump Comprising a Coated Rotor—May 11, 2006—English Translation (Year: 2006).*

Chinese-language Office Action issued in counterpart Chinese Application No. 201680023344.1 dated Dec. 25, 2018 with English translation (20 pages).

International Search Report (PCT/ISA/210) issued in PCT Application No. PCT/EP2016/061671 dated Sep. 16, 2016 with English translation (Six (6) pages).

German-language Written Opinion (PCT/ISA/237) issued in PCT Application No. PCT/EP2016/061671 dated Sep. 16, 2016 (Five (5) pages).

German-language Office Action issued in counterpart German Application No. 10 2015 212 724.9 dated Jan. 14, 2016 (Four (4) pages).

* cited by examiner 8
8a
8b
14
15
16
2
3
B
B*/2

EXTERNAL ROTOR PUMP WITH A SURFACE STRUCTURE HAVING A LOAD-BEARING REGION AND A NON-LOAD BEARING REGION

CROSS REFERENCE TO RELATED APPLICATIONS

This application is a continuation of PCT International Application No. PCT/EP2016/061671, filed May 24, 2016, which claims priority under 35 U.S.C. § 119 from German Patent Application No. 10 2015 212 724.9, filed Jul. 8, 2015, the entire disclosures of which are herein expressly incorporated by reference.

BACKGROUND AND SUMMARY OF THE INVENTION

The present invention relates to an external rotor pump, in particular a hydraulic external rotor pump, and different advantageous applications thereof.

In many applications, pumps are used in order to convey fluids, in particular liquids, liquid/solid admixtures, pastes and liquids with a low gas proportion. To this end, the drive work carried out by the pump is converted into the movement energy of the medium which is intended to be conveyed. In this context, extremely different pump types are known, in particular also positive-displacement pumps in which the medium is conveyed through at least temporarily self-contained volumes. Positive-displacement pumps also include so-called external rotor pumps in which an external rotor is rotatably supported in a counter-rotation member which may in particular be provided by the pump housing and furthermore an internal rotor which is rotatably supported eccentrically relative to the external rotor is provided. One of the rotors can be driven in order to be converted into a rotational movement and the rotors are coupled to each other in such a manner that, when the drive rotor is driven, the other rotor is thereby also caused to carry out a rotational movement in order to convey fluid from an intake region to a pressure region of the external rotor pump. The bearing of the external rotor in the counter-rotation member is in this instance generally substantially a plain bearing in which the frictional power is also determined by the bearing width.

External rotor pumps in particular also include the known internally toothed wheel pumps with or without a sickle-like member, toothed ring pumps, vane pumps and pendulum/slider pumps. In the case of the last ones, the counter-rotation member may in particular be provided by the so-called "slider", via which the conveying capacity of the pump can be adjusted in a variable manner.

In some specific applications, in particular also in oil pumps for internal combustion engines, such as, for instance, motor vehicle engines, it is additionally necessary to convey fluid at extremely different loads, in particular also under high pressure and/or high temperatures. In this instance, it is desirable with regard to the service-life and the degree of efficiency of the pumps to find a pump construction which has low wear and/or low friction to the greatest possible extent.

In this regard, it is known from the prior art to lubricate the movable components of external rotor pumps with a lubricant, in particular oil, in order to limit the friction which occurs during operation and consequently to reduce wear.

In still other known solutions, coats of low-wear material are used in order to prevent occurrences of wear at specific locations of the pump. In the International patent application WO 2006/047986 A1, there is accordingly described a pump, in particular a vane pump, having a rotor which is rotatably arranged between two side faces of the pump. In order to reduce an undesirable tendency for scuffing between the rotor and the side faces, the rotor is provided with a friction-reducing and wear-reducing coating.

Against this background, an object of the invention is to further improve external rotor pumps, with particular regard to the degree of efficiency thereof and the service-life thereof.

A solution to this problem is achieved by an external rotor pump, as well as a use of the external rotor pump, in accordance with embodiments of the invention.

Various embodiments and further developments of the invention are also described and claimed herein.

The invention is based, inter alia, on the recognition that for external rotor pumps, in particular when they have to be configured for high pressure and/or high temperatures, the smallest possible external rotor diameter is intended to be selected since this also determines the frictional power even more powerfully than the bearing width. Consequently, with a predetermined conveying volume, there is produced in most cases an increase of the bearing width beyond the dimension required for supporting and guiding the external rotor. Consequently, it would be advantageous with regard to the problem which is addressed above with a specific bearing width to further reduce the friction which occurs at the bearing, but without impairing the conveying volume.

A first aspect of the invention relates to an external rotor pump, in particular a hydraulic external rotor pump. The external rotor pump has a first component which is constructed as an external rotor and which has a sliding face which is arranged on the outer side thereof, and a second component which is constructed as a counter-rotation member and in which the external rotor is rotatably supported by means of the sliding face thereof on an inner guiding face of the counter-rotation member and is in mechanical contact therewith. Furthermore, the external rotor pump has an internal rotor which is rotatably supported eccentrically relative to the external rotor. This means that the rotation axes of the external rotor and the internal rotor at least in one setting of the pump do not coincide, although they may preferably extend parallel with each other. One of the rotors can be driven in particular via a shaft, in order to be caused to carry out a rotational movement. The rotors are coupled to each other in such a manner that, when the drivable rotor is driven, the other rotor is thereby also caused to carry out a rotational movement in order to convey fluid from an intake region to a pressure region of the external rotor pump. The sliding face or the guiding face has a surface structure which has a load-bearing region and a non-load-bearing region which is recessed relative thereto so that the non-load-bearing region remains unaffected by the contact between the guiding face and the sliding face which is supported thereon. In particular, both the sliding face and the guiding face may also at least partially each have such a surface structure.

A "hydraulic external rotor pump" in the context of the invention is intended to be understood to be an external rotor pump which can produce an almost continuous volume flow which also remains substantially constant when a pressure build-up occurs as a result of resistances in the hydraulic system.

A "counter-rotation member" in the context of the invention is intended to refer to a component for an external rotor pump which cooperates with an external rotor of the pump which is rotatably supported in the counter-rotation member and which in addition has a guiding face in order to consequently be in mechanical contact with a corresponding sliding face of the external rotor, in any case during operation of the pump, and in this instance to guide the rotation movement of the external rotor along the guiding face. In particular, toothed rings of internally toothed wheel pumps and toothed ring pumps and stroke rings or control rings of pendulum/slider pumps and vane pumps are counter-rotation members in the context of the invention.

The term "contact" in the context of the invention is intended to be understood to be a contact of two bodies, in particular of the first and second components, wherein, as a result of the contact, a force transmission can be transferred between the bodies. The contact may in particular be produced by means of direct contact of the surfaces of the bodies or be transmitted by means of an intermediate layer which is located between the surfaces, in this instance in particular between the guiding face and the sliding face. The intermediate layer may in particular be a lubricant film, for instance, of oil. The bearing of the external rotor in the counter-rotation member may consequently be constructed in particular as a hydrodynamic plain bearing.

A "sliding face" in the context of the invention is intended to be understood to be the surface region of the external rotor which is arranged and shaped in such a manner that it cooperates with the guiding face of the counter-rotation member by rolling or sliding thereon or both when the external rotor pump is driven. Accordingly, the sliding face (or when this has the surface structure only the load-bearing region thereof) at a specific time may be in contact with the guiding face in particular over the entire surface or in each case only with a part-region. In the latter case, during the rotation movement of the external rotor during operation, in particular gradually other part-regions of the sliding face can come into contact with the guiding face.

In a similar manner, the term "guiding face" in the context of the invention is intended to be understood to be the surface region of the counter-rotation member which is arranged and shaped in such a manner that it cooperates with the sliding face of the external rotor by rolling or sliding on the guiding face or both when the external rotor pump is driven. The guiding face (or when it has the surface structure, only the load-bearing region thereof) may also at a specific time be in contact with the sliding face in particular over the entire surface or only with a part-region. In the latter case, during the rotation movement of the external rotor during operation, in particular other part-regions of the guiding face can gradually come into contact with the sliding face.

A "rotation movement" in the context of the invention is intended to be understood to be a movement of a rigid member, in this instance a rotor which has a rotation as at least one movement component. The rotation is preferably a rotation about a rotation axis which in turn is preferably but not necessarily fixed. The movement may also have a translation component, but in view of the resulting increasing complexity of the movement, this is generally not the case in practice.

A "surface structure" in the context of the invention is intended to be understood to be a structure which is artificially produced in a surface of a member. A "structure" is in this instance intended to be understood to be height deviations of the actual interface of the surface from the ideally smooth averaged boundary plane. The production of the structure may in this instance be carried in particular out by means of laser processing, chemical or physical processing, by recesses or holes being produced by means of material removal in the surface or in contrast material being applied only in places or with different thicknesses to the surface. A combination of a material removal and a material application is also possible. The combination may in particular include a production of recesses and a coating of the non-recessed regions, optionally also the previously produced recesses, with a coating material. Natural or unavoidable occurrences of roughness or unevenness of a surface are not surface structures in the context of the invention in a scale-independent manner, that is to say, both on a micro and macro scale.

A "load-bearing" region in the context of the invention is accordingly intended to be understood to be a part-face of the sliding face of the external rotor which has the surface structure or the guiding face of the counter-rotation member which is raised with respect to the recessed, non-load-bearing region of the surface structure and which during operation of the external rotor pump at least temporarily comes into mechanical contact with the corresponding face of the other component, that is to say, the guiding face of the counter-rotation member or the sliding face of the external rotor. The load-bearing region may also have a plurality of non-coherent surface portions which together form the load-bearing region.

The actual contact face between the external rotor and the counter-rotation member is thus reduced to the load-bearing region, whereby the surface-dependent friction is reduced even with a consistent total surface-area of the sliding face or the guiding face and the problem addressed is thus achieved. Consequently, friction-related wear can also be reduced, which may have a positive effect on the service-life of the pump.

Preferred embodiments of the external rotor pump according to the invention and the developments thereof are described below and, as long as it is not expressly excluded, can each be freely combined with each other.

According to a first preferred embodiment, the first or second component which has the load-bearing region has a component member which is produced from at least one base material. Furthermore, the load-bearing portion of the surface structure which is formed on the component has on the surface thereof a carrier material which with respect to at least one of the base materials has a reduced friction coefficient or a higher wear resistance, in particular with respect to sliding friction, or both. In this manner, the friction, the wear or both can be even further reduced in order to increase the degree of efficiency and the service-life of the pump.

According to a preferred development of this embodiment, there may be formed in this instance on the component body on the load-bearing portion a layer of carrier material. The layer may be constructed in particular in the form of a coating of the component body, at least on the load-bearing region thereof, with a corresponding carrier material. This may include in particular spray-coating methods in which, as a result of an appropriate parameter selection for feed, direction and layer thickness, the desired structures can be produced. It is instead also possible for the layer to be constructed in the component body itself by means of chemically or physically induced material conversion or material introduction, for instance, by means of implantation, or a combination thereof. In this manner, the construction of the layer may take place after the production of the component body, whereby the production of the component body itself and the construction of the layer can be decoupled. This may in particular lead to a reduction of the production complexity.

According to a second preferred embodiment, which can be used in addition to or in place of the first embodiment, the first or second component which has the load-bearing region has a component body which is produced from at least one base material and one or more sliding members. In this instance, the sliding member is arranged on the component body in such a manner that the sliding member forms at least a portion of the load-bearing region and has a carrier material which with respect to at least one of the base materials has a reduced friction coefficient or a higher wear resistance or both. In this manner, it is in particular possible to produce the component body from a material, in particular a lightweight material, such as, for example, a light metal or a plastics material, which itself does not comply with the desired requirements in terms of low friction or low wear. The use of at least one sliding member is particularly advantageous when the material of the component member cannot be coated or can be coated only poorly with a carrier material which complies with the above-mentioned requirements.

According to a preferred development of this embodiment, the sliding member has a ring which surrounds the component body or is constructed as such. The component body may thus have, for instance, in particular according to a preferred variant a cylindrical surface on which such an annular sliding member is fitted in such a manner that it is positioned on the circular cylinder surface. The cylindrical surface may in particular be located on the outer periphery of the external rotor or be produced by the inner face of a cylindrical recess or hole in the counter-rotation member. A combination of a plurality of such annular sliding members which are preferably arranged parallel with each other also constitutes a preferred solution. With this development, it is possible in a simple manner with the external rotors, which are in most cases constructed in a substantially rotationally symmetrical manner and which are provided with a cylindrical periphery, to readily achieve a reduction of friction and wear. The assembly of the annular sliding member(s) may in particular be carried out by means of attachment and/or a materially engaging or a positive-locking connection with respect to the component body.

According to another preferred development of the above-mentioned embodiments, the carrier material has at least one of the following materials: carbon, in particular diamond-like carbon (DLC), lubricant varnish, hard metal, in particular chromium. In this instance, the known DLC materials represented a class of amorphous carbon materials which demonstrate some properties which are typical of diamond, in particular a high degree of hardness and abrasion-resistance which is brought about by a strong connection between the individual carbon atoms. Accordingly, such a material may advantageously be used for friction and wear reduction. DLC exists in seven different forms which all contain significant quantities of sp3-hybridized carbon atoms. The carrier material may in particular be produced completely or in any case substantially from one or more of the above-mentioned materials.

According to another preferred development of the above-mentioned embodiments, at least one of the base materials has at least one of the following materials: a plastics material; a light metal or a light metal alloy, a composite material, a sintered material or a steel material. Preferably, in particular one or more of the following base material(s) is/are used. High-performance plastics materials, such as, for example, polyamide 6.6 (PA 6.6), polyetherketone (PEEK); preferably also fiber-reinforced plastics materials on a thermoplastic or thermosetting matrix, such as, for example, phenoplasts (PF), for example, PF-(GF+GB)65, chlorofluorocarbons (CFC) or glass-fiber-reinforced plastics materials (GRP); or light metals based on magnesium or pure magnesium or aluminum alloys, such as, for example, AlSi9Cu3. Sintered metals may include in particular a Sint D39 material. Steel materials, such as, for example, CrMo or heat-treated steels, are also suitable base materials. The first or second component which has the surface structure may in particular be produced completely or in any case substantially from one or more of the above-mentioned materials.

According to another preferred embodiment, the non-load-bearing region of the external rotor or the counter-rotation member is constructed at least partially in the form of one or more linear recesses in the sliding face or the guiding face. In particular, the linear recess may be constructed in the form of at least one groove, preferably as at least one groove which extends in the sliding face or guiding face. In this manner, the surface structure can already be produced in a simple manner during the production of the external rotor or the counter-rotation member, for instance, by means of a casting method, or by means of subsequent processing, for instance, by means of milling or a pull type keyseating machine. In this instance, the cross-section of the recess may in particular be rectangular or trapezoidal.

According to a preferred development of this embodiment, the non-load-bearing region of the external rotor or the counter-rotation member is constructed at least partially in the form of a plurality of linear recesses which extend substantially parallel with each other in the sliding face or the guiding face. In this manner, a desired relationship involving the surface of the load-bearing region with respect to the total surface-area of the sliding face or guiding face can be selected not only via the width of a linear recess itself, but also via the number thereof so that in particular also small line widths are possible without the relationship having to be adapted thereto. The load-bearing region can thus be sub-divided into a large number of individual surface portions, which are at least partially separated from each other by the linear recesses. This may have the advantage that in contrast to embodiments in which the load-bearing region comprises only one or very few surface portion(s), the edge load on the load-bearing regions and consequently their susceptibility with respect to wear or their contribution to friction can be reduced. Such a surface structure may also advantageously promote the wetting with lubricant and consequently the construction and maintenance of a friction-reducing lubricant film at the interface between the counter-rotation member and external rotor.

According to preferred developments of this embodiment, the linear recesses have one of the following extents, wherein the movement direction of the external rotor with respect to the counter-rotation member defines, when the drivable rotor is driven, a reference direction on the sliding face or the guiding face: (i) at least substantially linear and parallel or anti-parallel with respect to the reference direction, (ii) jagged or undulating and extending at least partially obliquely with respect to the reference direction, or (iii) linear, jagged or undulating and generally angled so that the angle forms the shape of an arrow with an arrow direction which extends at least substantially in or counter to the reference direction. In this instance, the term "substantially" is intended to be understood to mean that the value of the deviation from the mentioned direction is a maximum of 5 degrees, wherein the smallest angle which occurs is intended to be considered between the linear extents of the recesses which are intended to be compared. Such surface structures which comprise a plurality of parallel linear recesses can advantageously be used in particular in the field of hydrodynamic friction in order to reduce friction and wear in comparison with the use of smooth faces without a surface structure.

According to another preferred embodiment, the load-bearing region is structured in such a manner that the maximum surface pressure which is applied thereto during operation of the external rotor pump, at least in an operating mode of the external rotor pump, does not vary by more than 10%, preferably no more than 5%, and in a particularly preferred manner no more than 2% over the load-bearing region. This may in particular be achieved by the surface density which is defined as the relationship of the surface-area of the load-bearing region to the total surface-area comprising the load-bearing and non-load bearing region being substantially constant over the sliding face or the guiding face or in any case varying only within the above-mentioned limits. In this manner, an excessive loading of individual surface portions of the load-bearing region is prevented, which in turn can counteract premature wear and an increase of the friction action.

According to another preferred embodiment, the pump further has at least one lubricant supply channel for supplying lubricant to lubricate the boundary layer between the sliding face and the guiding face and at least one lubricant discharge channel for discharging the lubricant. In this manner, the friction and the wear can be further reduced, wherein the lubricant is efficiently supplied in a selective manner in particular in the context of a forced lubrication at the—or at least one—location which is relevant or particularly suitable for the lubrication.

According to a preferred development of this embodiment, to this end the lubricant supply channel or at least one of the lubricant supply channels is arranged in such a manner that it opens at a location in the boundary layer, at which, during operation of the pump, the load-bearing region is at least temporarily located so that it can be provided at that location with the lubricant provided from the lubricant supply channel. Preferably, the opening location is in a region of below-average pressure loads at the boundary layer so that the penetration of the lubricant into the boundary layer is facilitated.

According to another development of this embodiment, the lubricant discharge channel or at least one of the lubricant discharge channels is arranged in such a manner that the input thereof is arranged adjacent to a location of the boundary layer at which the non-load-bearing region is at least temporarily located during operation of the pump so that, from this location via the corresponding lubricant discharge channel, lubricant can be discharged from the non-load-bearing region. Consequently, the lubricant discharge from at least one region, at which the lubricant preferably accumulates in one of the recesses of the non-load-bearing region, can be efficiently discharged. Afterwards, for instance, by means of a filter, it can be cleaned and/or cooled and then supplied again via the lubricant supply channel to the boundary layer.

According to other preferred embodiments, the construction type of the external rotor pump is one of the following: an internally toothed wheel pump, with or without a sickle-like member, a toothed ring pump, a vane pump or a pendulum/slider pump. Accordingly, with the external rotor pump according to the invention, the coupling between the internal rotor and the external rotor can be carried out depending on the construction type in particular by means of tooth meshing or by means of pendulum/slider pieces or vanes, as is the case with the above-mentioned known pump types.

A second aspect of the invention relates to a use of the external rotor pump according to the first aspect of the invention as:

- a drive for hydraulic power converters, preferably in a construction machine, a machine tool or a pulling machine or a vehicle;
- a conveyor for conveying lubricant, fuel or combustible or fluids having a viscosity of more than 70 mm2/s at 20° C. or at pressures beyond 0.2 MPa; or
- circulation pumps, in particular in a coolant circuit.

In particular with these above-mentioned applications, increased pressure or increased temperature may regularly occur in regions in which, without suitable counter-measures, friction and consequently material loads increasingly occur in a pressure or temperature-related manner, which may lead to a decrease in the degree of efficiency and/or the service-life of the pump.

In particular, the external rotor pump according to the invention may preferably be used as an oil pump for combustion engines, in particular for internal combustion engines of motor vehicles, where high pressures and temperatures are normal and the pump is often coupled to the internal combustion engine in such a manner that it is operated in a comparable or the same speed range, for example, up to a few thousand rpm. With high-power engines, for example, values of over 8000 rpm are not untypical. The mechanical and thermal loads of the pump may then also be correspondingly high.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
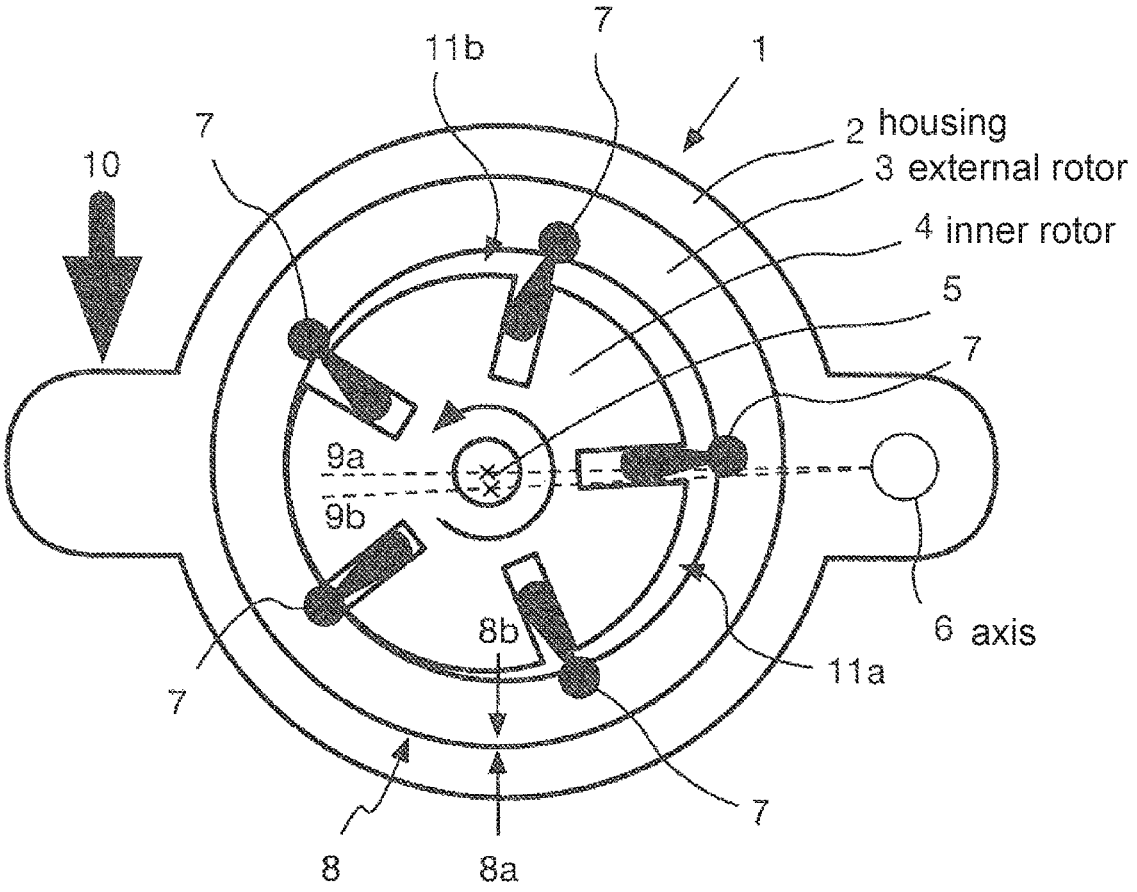
FIG. 1 is a schematic view of a pendulum/slider pump according to a preferred embodiment of the invention.

Reference is first made to FIG. 1, wherein the same reference numerals have the same meaning in all the Figures. In FIG. 1, an external rotor pump 1 is shown in the form of a pendulum/slider pump. It has an external rotor 3 which is supported on a circumferential interface 8 with the sliding face 8*b* thereof which extends on the outer periphery thereof in a counter-rotation member 2. The counter-rotation member 2 is constructed as a pump housing on the inner face thereof which acts as a guiding face 8*a* for the external rotor 3 and which is directed toward the (virtual) rotation axis thereof. Furthermore, there is provided an inner rotor 4 which in turn is arranged inside the external rotor 3 and which is rigidly connected to a rotatably supported shaft 5 so that the inner rotor 4 can be driven via the shaft 5. The outer diameter of the internal rotor 4 is smaller than the inner diameter of the external rotor 3 so that there is a hollow space between the two rotors 3 and 4 whose position changes during conveying operation of the pump 1. Between the external rotor 3 and the driven internal rotor 4 there is a mechanical coupling. In addition, the internal rotor has a plurality of radially extending, shaft-like recesses in which there are located pendulum pieces 7 which are supported in the corresponding recesses so as to be able to be freely moved and tilted in a limited manner.

The pendulum pieces 7 each have spherical pendulum heads which protrude from the recesses of the internal rotor 4 and which engage in corresponding recesses at the inner side of the external rotor 3 and are supported in an articulated manner at that location. When the internal rotor 4 is driven by way of the shaft 5, a torque is consequently applied by the pendulum pieces 7 to the external rotor 3 which converts it into a rotation in the same direction as the rotation of the internal rotor 4.

The pump housing, that is to say, the counter-rotation member 2, has at the outer periphery thereof two projections, wherein there is provided in one of them a rotation axis 6 about which the counter-rotation member is rotatably supported through a limited angle. If, as indicated by an arrow, a force 10 is applied to the opposing projection, the rotation axis of the counter-rotation member 2 indicated by way of a cross and consequently also the external rotor 3 which is supported therein rotates with respect to the shaft 5 of the internal rotor 4, as indicated by the line 9*a* (starting position) and 9*b* (position after rotation). In this manner, it is possible to adjust the conveying quantity of the pump in a variable manner within specific limits. In this instance, in the starting position, the rotation axes of the external rotor 3 and the internal rotor 4 coincide so that both rotors run concentrically and the conveying chambers between the pendulum sliders 7 do not change. The pump therefore does not convey in this position (zero delivery). However, if the counter-rotation member 2 and consequently also the external rotor 3 which is supported therein is rotated by the force 10 to the position 9*b*, the rotation axis of the driven internal rotor 4 is located eccentrically with respect to the external rotor 3 so that the conveying chambers in the hollow space between the rotors in the region of the individual pendulum pieces periodically increase (intake region 11*a*) and decrease again (pressure region 11*b*) and consequently the medium which is intended to be conveyed can generally be pumped.

At the interface 8, either the guiding face 8*a* of the counter-rotation member 2 or the sliding face 8*b* of the external rotor 3 has a surface structure. Solutions in which both the guiding face 8*a* and the sliding face 8*b* each have a surface structure are possible, preferably in such a manner that, during the contact of both faces, the surface structures of both faces do not overlap but instead each only covers a part-region of the contact face between both faces so that a possible increase of friction can be prevented by means of direct interaction between the surface structures of the guiding face 8*a* and the sliding face 8*b* from the beginning and in a structurally independent manner.

Figure 2:
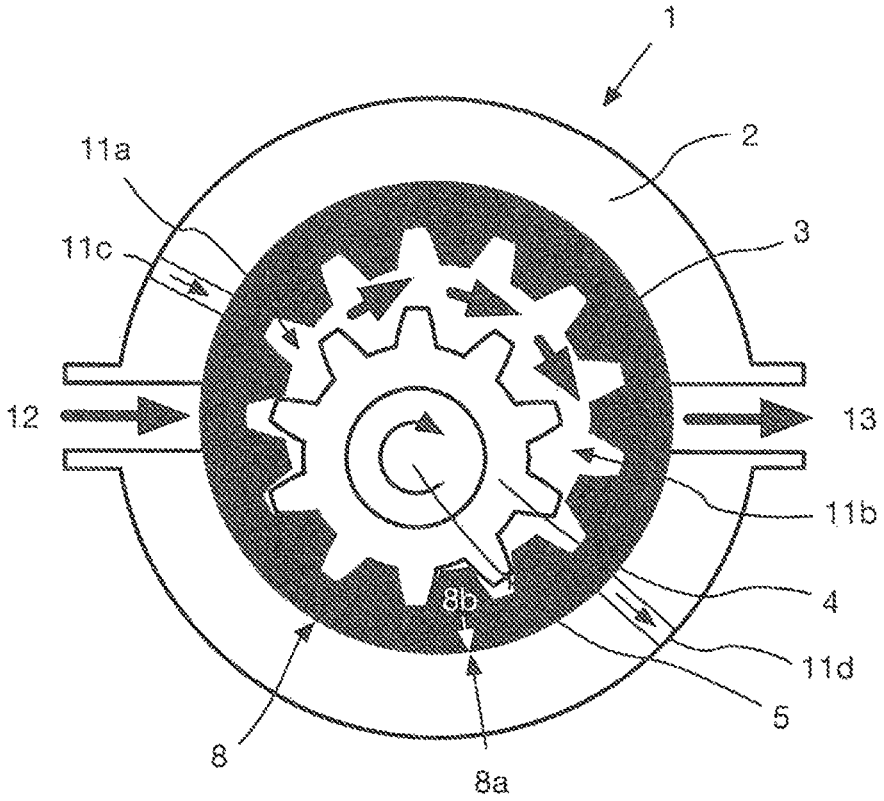
FIG. 2 is a schematic view of an internally toothed wheel pump (without any sickle-like member) according to another preferred embodiment of the invention.

FIG. 2 shows another embodiment of the pump 1 according to the invention in the form of an internally toothed wheel pump (without a sickle-like member). There is again provided a pump housing which acts as a counter-rotation member 2 for an external rotor 3 which is rotatably supported therein. As with the pump from FIG. 1, a guiding face 8*a* which is located on the inner face of the counter-rotation member 2 and a sliding face 8*b* which is located on the outer periphery of the external rotor 3 meet at an interface 8. Furthermore, there is again provided an internal rotor 4 which is rotatably supported about a shaft 5 at the inner side of the external rotor 3. In order to couple the two rotors, the internal rotor 4 is constructed as a toothed wheel which engages in a toothed ring which is constructed at the inner side of the external rotor 3. The rotation axes of the external rotor 3 and internal rotor 4 which extend parallel with each other are located eccentrically with respect to each other. The outer diameter of the internal rotor 4 is again smaller than the internal diameter of the external rotor 3 so that a hollow space exists between the two rotors 3 and 4 and the position thereof changes during conveying operation of the pump 1. There are thus continuously produced intake regions 11*a* at which the hollow space increases, and pressure regions which the hollow space adjoins when the internal rotor 4 runs in the toothed ring of the external rotor 3. The counter-rotation member 2 has a conveying medium supply channel 12 and a conveying medium discharge channel 13. Furthermore, in order to lubricate the pump 1, a lubricant supply channel 11*c* and a lubricant discharge channel 11*d* are provided (in FIG. 1, the corresponding conveying medium and lubricant channels are not explicitly shown, but are also present).

Figure 3:
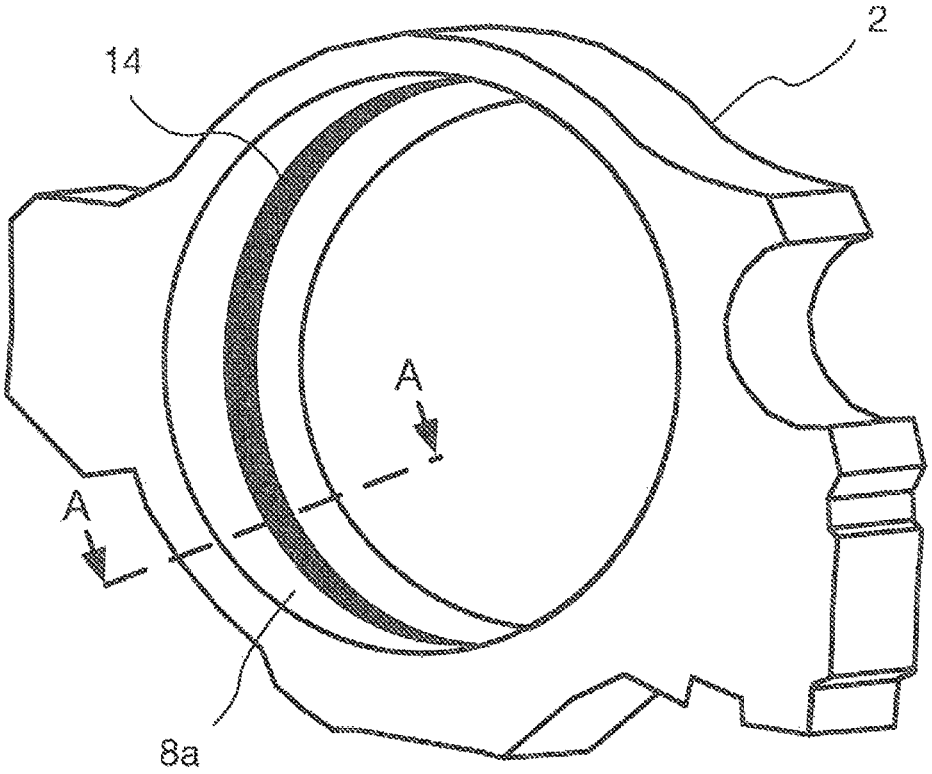
FIG. 3 is a schematic perspective view of a counter-rotation member according to a preferred embodiment of the pump with a visible guiding face, which has a surface structure with a groove as a non-load-bearing region.

Preferred embodiments for the surface structure of the guiding face 8*a* or the sliding face 8*b* are illustrated by way of example in FIGS. 3 to 5. In this instance, FIG. 3 shows a counter-rotation member 2 of an external rotor pump 1 with the guiding face 8*a* thereof. Such a counter-rotation member 2 may in particular be used for the pump constructions according to FIG. 1 or FIG. 2. Along the guiding face 8*a*, a circumferential recess in the form of a circular groove 14 is preferably formed centrally in the guiding face 8*a*. However, the path of the groove does not have to be circumferential. It is preferably adapted to surface pressures which may be present in the guiding face 8*a*. The groove width may also be adapted thereto. In particular the groove width may also vary over the path of the groove. The circular face defined by the circular groove 14 is substantially perpendicular to the rotation axis of an external rotor 3 when it is inserted in the counter-rotation member 2, as shown in FIGS. 1 and 2. The surface region of the guiding face 8*a* defined by the groove 14 constitutes a non-load-bearing region of the guiding face 8*a*, whilst the remaining peripheral surface regions which adjoin the groove 14 at both sides form the load-bearing region which comes into contact with the sliding face 8*b* of the external rotor 3.

Different embodiments of preferred surface structures for the guiding face 8*a* or for the sliding face 8*b* are illustrated in FIGS. 4B to 4F in the form of cross-sections through the counter-rotation member 2 and the adjacent external rotor 3. The cross-sections shown accordingly always extend in this instance with respect to the counter-rotation member 2 in the manner as illustrated in the specific case of FIG. 3 with reference to the line of section A-A.

Figures 4A, 4B, 4C, 4D, 4E, 4F:
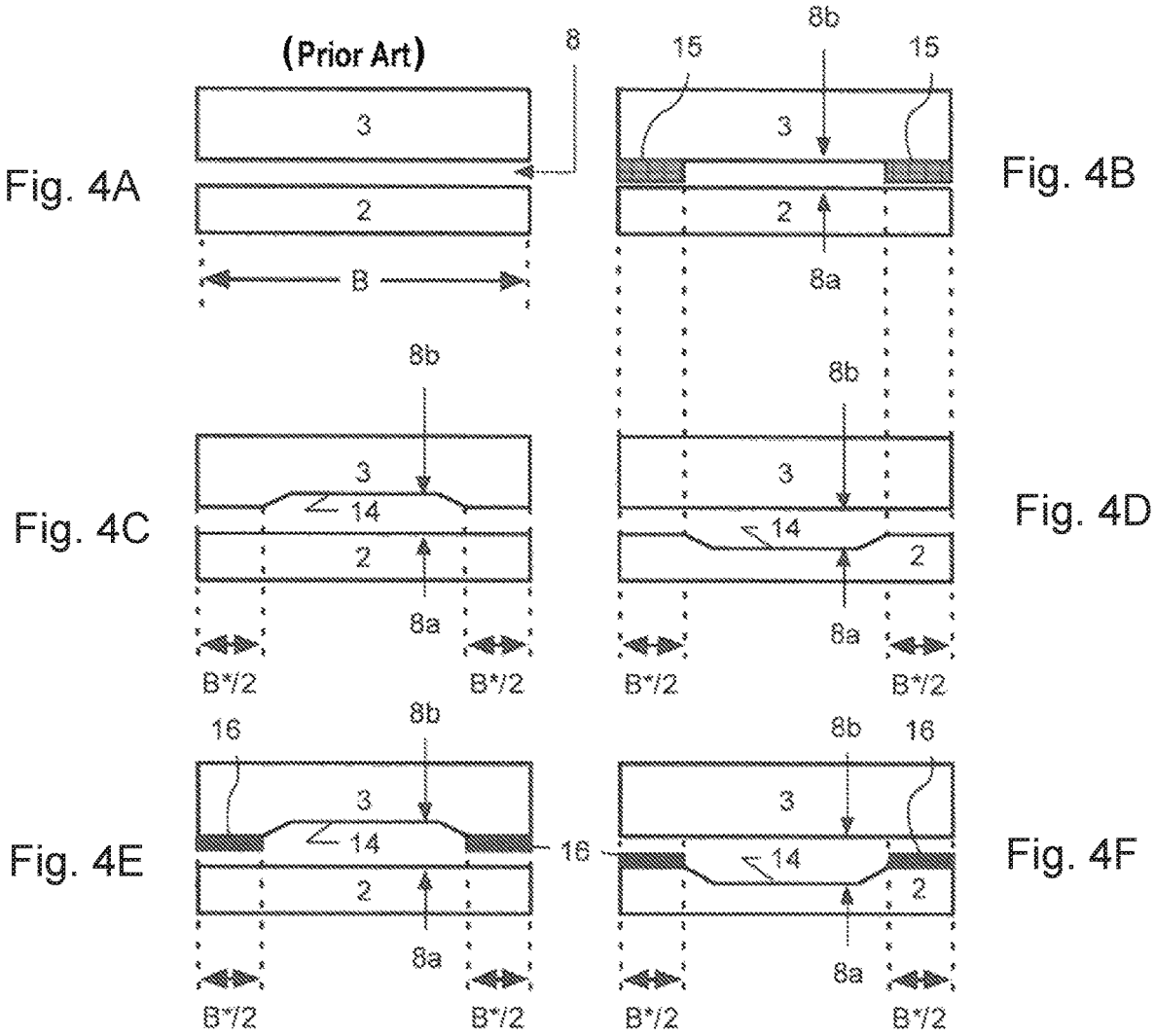
(Prior Art) Fig. 4A
FIGS. 4A-4F schematically show a plurality of cross-sections through pumps according to different preferred embodiments of the invention in order to illustrate the surface structure of the external rotor or the counter-rotation member in comparison with a conventional external rotor pump.

FIG. 4A first shows in the same manner the starting point according to the prior art, in which both the guiding face 8*a* and the sliding face 8*b* are each constructed as smooth surfaces on the counter-rotation member 2 or the external rotor 3 and form the interface 8 at the contact location thereof. Accordingly, the contact face extends between the counter-rotation member 2 and the external rotor 3 over the entire overlapping bearing width B thereof.

FIG. 4B relates to a preferred embodiment of the invention in which two sliding members 15 which are constructed as sliding rings are fitted to the sliding face 8*b* of the external rotor 3 and are constructed from a particularly low-friction and low-wear material. The material may in particular have one or more CrMo steels or one or more heat-treated steels and preferably at least substantially comprise one or more of these materials. In this manner, it is possible to construct the component member of the external rotor 3 from a less low-wear material, such as, for instance, a light metal or plastics material, without increasing the friction and the wear at the interface 8. The guiding face 8*a* of the counter-rotation member 2 remains in this embodiment preferably without a surface structure so that the sliding rings 15 can slide thereon in a low-friction manner to the greatest possible extent.

FIGS. 4C and 4D relate to two mutually related additional preferred embodiments of the invention in which in each case one of the two faces which are in contact at the interface 8 has a surface structure which is formed by way of a continuous groove 14. The groove 14 constitutes in each case a non-load-bearing region of the corresponding face, whilst the remaining surface region acts as a load-bearing region. In FIG. 4C, the groove is formed in the sliding face 8*b*, whilst the guiding face 8*a* of the counter-rotation member 2 does not have any surface structure. FIG. 4D shows in contrast the reverse case which is also illustrated in FIG. 3, in which the groove 14 is located in the guiding face of the counter-rotation member 2. In both cases, the effective support face, that is to say, the contact face between the guiding face 8*a* and the sliding face 8*b*, consequently has an effective bearing width $B^*<B$ which, as shown, can be divided in particular into two portions of equal width which form the load-bearing region and which have the width $B^*/2$ on the left and right of the groove 14 which constitutes the non-load-bearing region.

FIGS. 4E and 4F relate to preferred developments of the solutions according to FIGS. 4C and 4D in which the load-bearing regions are in each case provided with a layer 16 of a particularly low-wear and low-friction carrier material which in particular may have chromium, DLC carbon or a lubricant varnish. The layer may in particular be constructed in the form of a coating. Using the layer, the friction which occurs at the interface 8 and the related wear can be further reduced. In a variant of these embodiments, however, the layer 16 is at least partially constructed by means of a selective material change, in particular by means of implantation of foreign materials in the load-bearing regions of the face or faces which has/have the surface structure so that these regions have an increased friction and wear resistance with respect to the previously unprocessed surface structure or the component body. Suitable foreign materials include in particular nitrogen, argon and ion gases generally and multi-ions, in particular metal or complex ions.

FIGS. 5A-5E show additional preferred embodiments for the surface structure, which are advantageous in particular in the field of hydrodynamic friction when a lubricant is used at the interface 8. In this instance, the surface structure has in each case a plurality of linear line-like recesses which extend at least substantially parallel with each other, in particular grooves, which are in this instance illustrated as a dark line, respectively. The structuring may in particular be produced by way of spray coating by suitable parameters for the selection of feed, direction and thickness of the injection coating produced. Alternatively, the component of the pump 1 which has the surface structure may be cast or pressed, wherein the surface structure is predetermined in this instance in each case by means of a casting mould or pressing mould. Furthermore, a structuring of the surface by means of laser beam technology is also possible. Adjacent recesses preferably have a spacing in the order of magnitude of the recess depth itself, in particular the spacing may be equal to the recess width or less than ten times the width. In this manner, the wetting of the surface structure with lubricant and consequently a consistent friction reduction can be promoted.

Figure 5A:
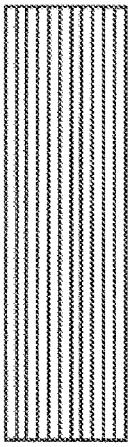
FIGS. 5A-5E show other surface structures from a large number of mutually parallel linear load-bearing and non-load-bearing regions according to other preferred embodiments of the invention.
Figure 5B:
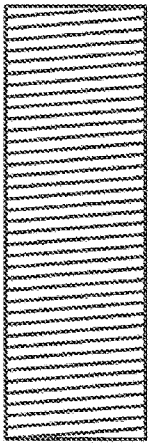
Figure 5C:
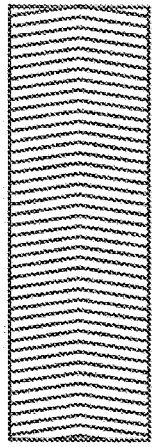
Figure 5D:
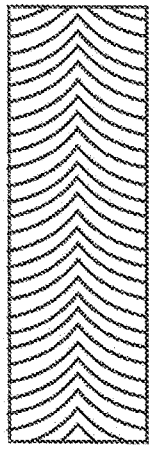
Figure 5E:
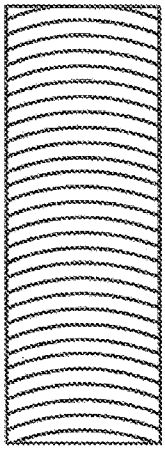

In FIG. 5A, the linear recesses of the non-load-bearing regions of the surface structure extend substantially in a straight line and parallel or antiparallel with the movement direction of the external rotor with respect to the counter-rotation member when the drivable rotor is driven which in this instance a reference direction constitutes. In another variant, non-load-bearing regions, as also shown in FIG. 5B, may extend at least partially in an inclined manner with respect to the reference direction. In this instance, the lines themselves may preferably be constructed so as to extend in a linear manner (as shown) or jagged manner per se or in an undulating manner. In another variant which is shown in FIG. 5C, the non-load-bearing regions also extend in a linear, jagged or undulating manner and are additionally generally angled so that the angle forms an arrow shape with an arrow direction which extends at least substantially in or counter to the reference direction. In FIG. 5D, another variant is shown in the form of a modification of the arrow shape from FIG. 5C in which at least one of the line segments which form the arrow shape is not constructed in a linear manner, but instead in a curved manner. The surface structure which is defined in this manner may also be referred to as an undulating form. Finally, FIG. 5E shows another variant in which the non-load-bearing regions are arranged in a curved shape which extends transversely relative to the reference direction. The spacing of adjacent non-load-bearing regions is in this instance preferably selected to be so small that always at least two adjacent load-bearing regions which are separated by a non-load-bearing region come into contact at the same time with the corresponding counter-face 8*a* or 8*b* at the interface 8 so that smooth running or sliding of the external rotor 3 with respect to the counter-rotation member 2 is ensured. All of these shapes have in common that they at least substantially have no line portions which extend perpendicularly to the reference direction since they could have a negative influence on the smooth running and consequently also the friction and wear which occur. Furthermore, the lubricant may also in each case flow at least also in the reference direction or in the opposite direction thereto in the recesses so that, as a result of the mentioned line shapes, lubricant inclusions which disrupt the smooth running are also effectively counteracted.

Whilst at least one exemplary embodiment has been described above, it should be noted that there are a large number of variations thereof. It should also be noted that the described exemplary embodiments constitute only non-limiting examples and it is not intended to thereby limit the scope, the applicability or the configuration of the devices and methods described here. Instead, the above description will provide the person skilled in the art with an indication for implementing at least one exemplary embodiment, wherein it will be understood that different modifications in the operating method and the arrangement of the elements described in an exemplary embodiment can be carried out, without deviating from the subject-matter which has been set out in the appended claims and the legal equivalents thereof.

LIST OF REFERENCE NUMERALS

1 External rotor pump
2 Counter-rotation member
3 External rotor
4 Internal rotor
5 Shaft
6 Rotation axis
7 Pendulum pieces
8 Interface
8*a* Guiding face
8*b* Sliding face
9*a* Starting position (zero delivery)
9*b* Position after rotation (delivery)
10 Force
11*a* Intake region
11*b* Pressure region
11*c* Lubricant supply channel
11*d* Lubricant discharge channel
12 Conveying medium supply channel
13 Conveying medium discharge channel
14 Recess in the surface structure, in particular groove
15 Sliding member, in particular sliding ring
16 Carrier material or a layer having such material
B Bearing width in solution from the prior art
B* Effective bearing width in solution according to the invention The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An external rotor pump, comprising:

a first component which is constructed as an external rotor and which has a sliding face which is arranged on an outer side thereof;

a second component which is constructed as a counter-rotation member and in which the external rotor is rotatably supported by way of the sliding face thereof on an inner guiding face of the counter-rotation member and is in mechanical contact therewith;

an internal rotor which is rotatably supported eccentrically relative to the external rotor;

wherein one of the rotors is drivable in order to be caused to carry out a rotational movement and the rotors are coupled to each other such that, when the drivable rotor is driven, the other rotor is thereby also caused to carry out a rotational movement in order to convey fluid from an intake region to a pressure region of the external rotor pump, the sliding face or the inner guiding face has a surface structure which has a load-bearing region and a non-load-bearing region which is recessed relative thereto so that the non-load-bearing region remains unaffected by contact between the guiding face and the sliding face which is supported thereon, the external rotor pump further comprises at least one lubricant supply channel for selectively supplying lubricant to lubricate a boundary layer between the sliding face and the inner guiding face, and at least one lubricant discharge channel for discharging the lubricant, the lubricant supply channel is arranged such that it opens at a location in the boundary layer, at which, during operation of the pump, the load-bearing region is at least temporarily located so that it is provided at that location with the lubricant provided from the lubricant supply channel, and the lubricant discharge channel is arranged such that the input thereof is arranged adjacent to a location of the boundary layer at which the non-load-bearing region is at least temporarily located during operation of the pump so that, from this location via the corresponding lubricant discharge channel, lubricant is discharged from the non-load-bearing region.

2. The external rotor pump as claimed in claim 1, wherein:

the first or second component which has the load-bearing region has a component body produced from at least one base material, and the load-bearing region has on a surface thereof a carrier material which, with respect to at least one of the base materials, has a reduced friction coefficient or a higher wear resistance, or both.

3. The external rotor pump as claimed in claim 2, wherein a layer of carrier material is formed on the component body on the load-bearing portion.

4. The external rotor pump as claimed in claim 2, wherein the carrier material comprises one or more of:

carbon, lubricant varnish, and hard metal.

5. The external rotor pump as claimed in claim 4, wherein at least one of the base materials comprises one or more of:

a plastics material, a light metal or a light metal alloy, a composite material, a sintered material, and a steel material.

6. The external rotor pump as claimed in claim 2, wherein at least one of the base materials comprises one or more of:

a plastics material, a light metal or a light metal alloy, a composite material, a sintered material, and a steel material.

7. The external rotor pump as claimed in claim 1, wherein the first or second component which has the load-bearing region has a component body, produced from at least one base material, and a sliding member, the sliding member is arranged and fitted on the component body such that the sliding member forms at least a portion of the load-bearing region and has a carrier material which, with respect to at least one of the base materials, has a reduced friction coefficient or a higher wear resistance, or both.

8. The external rotor pump as claimed in claim 7, wherein the sliding member has a ring which surrounds the component body.

9. The external rotor pump as claimed in claim 1, wherein the non-load-bearing region of the external rotor or the counter-rotation member is constructed at least partially in thea form of at least one linear recess in the sliding face or the inner guiding face.

10. The external rotor pump as claimed in claim 9, wherein the non-load-bearing region of the external rotor or the counter-rotation member is constructed at least partially in a form of a plurality of linear recesses which extend parallel with each other in the sliding face or the inner guiding face.

11. The external rotor pump as claimed in claim 10, wherein a movement direction of the external rotor with respect to the counter-rotation member defines, when the drivable rotor is driven, a reference direction on the sliding face or the inner guiding face and the linear recesses have one of the following paths:

linear and parallel or anti-parallel with respect to the reference direction, linear, jagged or undulating and extending at least partially obliquely with respect to the reference direction, or linear, jagged or undulating and angled so that an angle forms an arrow-shape with an arrow direction which extends in or counter to the reference direction.

12. The external rotor pump as claimed in claim 1, wherein the load-bearing region is structured such that a maximum surface pressure which is applied thereto during operation of the external rotor pump, at least in one operating mode of the external rotor pump, does not vary by more than 10%.

13. The external rotor pump as claimed in claim 1, wherein the load-bearing region is structured such that a maximum surface pressure which is applied thereto during operation of the external rotor pump, at least in one operating mode of the external rotor pump, does not vary by more than 5%.

14. The external rotor pump as claimed in claim 1, wherein the load-bearing region is structured such that a maximum surface pressure which is applied thereto during operation of the external rotor pump, at least in one operating mode of the external rotor pump, does not vary by more than 2%.

15. The external rotor pump as claimed in claim 1, wherein the pump is a hydraulic external rotor pump.

16. An external rotor pump, comprising:

a first component which is constructed as an external rotor and which has a sliding face which is arranged on an outer side thereof;

a second component which is constructed as a counter-rotation member and in which the external rotor is rotatably supported by way of the sliding face thereof on an inner guiding face of the counter-rotation member and is in mechanical contact therewith; and an internal rotor which is rotatably supported eccentrically relative to the external rotor;

wherein one of the rotors is drivable in order to be caused to carry out a rotational movement and the rotors are coupled to each other such that, when the drivable rotor is driven, the other rotor is thereby also caused to carry out a rotational movement in order to convey fluid from an intake region to a pressure region of the external rotor pump, the sliding face or the inner guiding face has a surface structure which has a load-bearing region and a non-load-bearing region which is recessed relative thereto so that the non-load-bearing region remains unaffected by contact between the guiding face and the sliding face which is supported thereon, the first or second component which has the load-bearing region has a component body produced from at least one base material, the load-bearing region has on a surface thereof a carrier material which, with respect to at least one of the base materials, has a reduced friction coefficient or a higher wear resistance, or both, the carrier material comprises one or more of:

carbon, lubricant varnish, and hard metal, and wherein the carbon is DLC carbon and the hard metal is chromium.

* * * * *